United States Patent [19]

Cole

[11] Patent Number: 4,509,758

[45] Date of Patent: Apr. 9, 1985

[54] CRYPTOGRAPHIC GAME APPARATUS AND MODE OF PLAY

[76] Inventor: Joycene L. Cole, 10875 Kling St., North Hollywood, Calif. 91602

[21] Appl. No.: 523,425

[22] Filed: Aug. 16, 1983

[51] Int. Cl.[3] ..... A63F 9/00; A63F 9/04; G09C 1/00

[52] U.S. Cl. ..... 273/240; 273/272; 273/145 C; 434/119

[58] Field of Search ..... 273/272, 240, 145 C, 273/144 B, 138 R; 434/119

[56] References Cited

U.S. PATENT DOCUMENTS

| | | | |
|---|---|---|---|
| 497,726 | 5/1893 | Phelps | 273/138 R |
| B 511,454 | 2/1976 | Farmer | 434/119 X |
| 706,658 | 8/1902 | Hock | 273/113 |
| 1,136,875 | 4/1915 | Hebern | 434/119 |
| 1,766,521 | 6/1930 | Klink | 273/123 R X |
| 1,874,930 | 8/1932 | Dorsch | 273/138 R |
| 2,739,815 | 3/1956 | Fay | 273/145 C |
| 3,117,789 | 1/1964 | Wiebe | 273/272 |
| 3,204,345 | 9/1965 | Buckner | 273/145 C X |
| 3,724,847 | 4/1973 | Compton | 273/145 C X |
| 3,746,342 | 7/1973 | Fine | 273/144 B |
| 3,891,218 | 6/1975 | Hilgartner et al. | 273/272 |
| 4,383,689 | 5/1983 | Kohner et al. | 273/145 R |

FOREIGN PATENT DOCUMENTS

| | | | |
|---|---|---|---|
| 2455777 | 1/1981 | France | 273/144 B |
| 505689 | 5/1939 | United Kingdom | 273/145 C |
| 897402 | 5/1962 | United Kingdom | 273/144 B |

*Primary Examiner*—Richard C. Pinkham
*Assistant Examiner*—Scott Brown
*Attorney, Agent, or Firm*—Cislo, O'Reilly & Thomas

[57] ABSTRACT

A cryptographic game and apparatus therefor, including an encrypting box with a plurality alphabetically labeled compartments, a plurality of alphabetically labeled members adapted to be randomly placed in the compartments, a first pad of sheets containing messages to be encrypted, and a second pad of sheets employed by players to decipher the message.

6 Claims, 5 Drawing Figures

CRYPTOGRAPHIC GAME APPARATUS AND MODE OF PLAY

BACKGROUND OF THE INVENTION

Word games, wherein letters of the alphabet are employed to form words are well known to the art. Cryptographic word games, wherein letters forming a message are systematically substituted for others, the players attempting to determine the original message, are also well known to the art.

In the game of the present invention, one player employs a box-like encrypting device. The encrypting device contains a plurality of indicia-bearing cubes, one for each letter of the alphabet. In addition, a plurality of compartments are provided, one labeled with each letter of the alphabet. The encrypting device is shaken whereby each of the indicia-bearing cubes rests in a randomly selected indicia-bearing compartment. The resulting relationship between the letter of the cube and the letter of the compartment is completely random. The player bearing the encrypting device then encrypts one of a number of given messages forming part of the game apparatus. The encrypted message is then given, letter by letter, to the other players. Each player in turn then attempts to learn from the encrypter the original letters forming the message, eventually determining the message within a preset time limit.

DETAILED DESCRIPTION OF THE INVENTION

Figure 1:
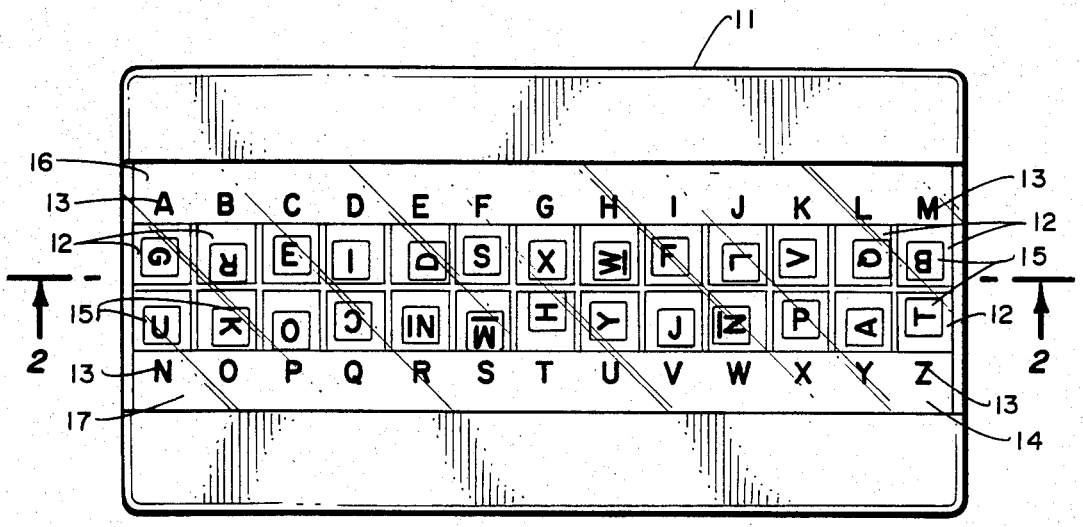
FIG. 1 is a plan view of an encrypting device employed in the game of the present invention.
Figure 2:
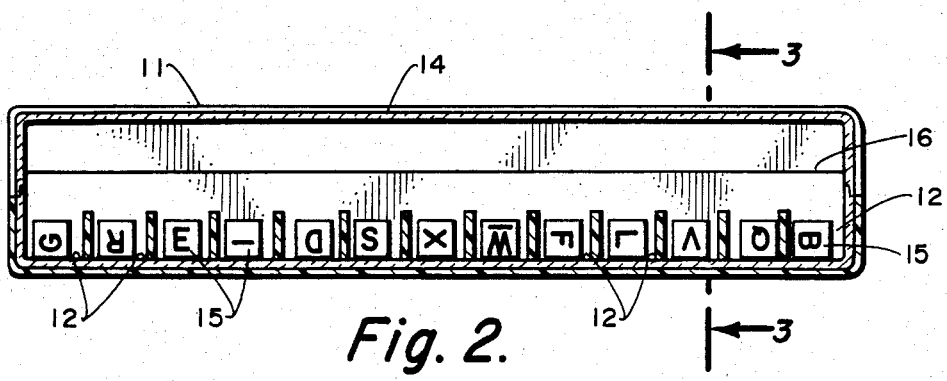
FIG. 2 is a longitudinal cross-section of the encrypting device of FIG. 1 taken along 2—2.
Figure 3:
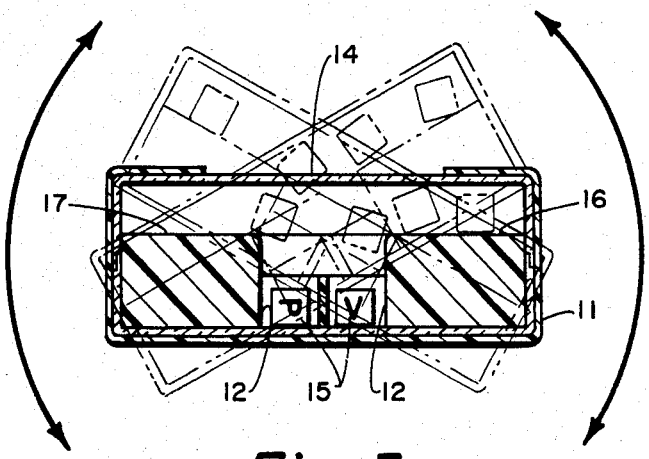
FIG. 3 is a lateral cross-section of the encrypting device, taken along 3—3 of FIG. 2, illustrating the mode of manipulation.
Figure 4:
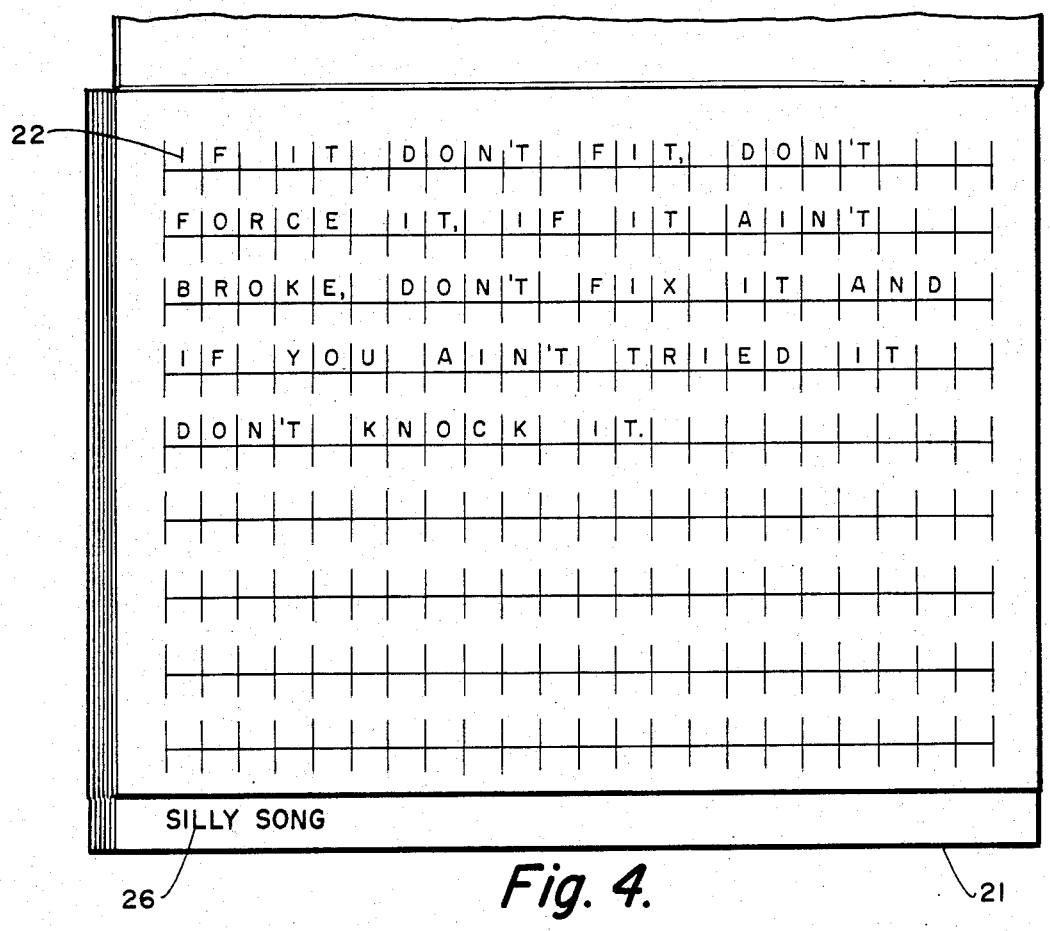
FIG. 4 illustrates a pad containing hatched sheets of paper bearing messages to be encrypted.
Figure 5:
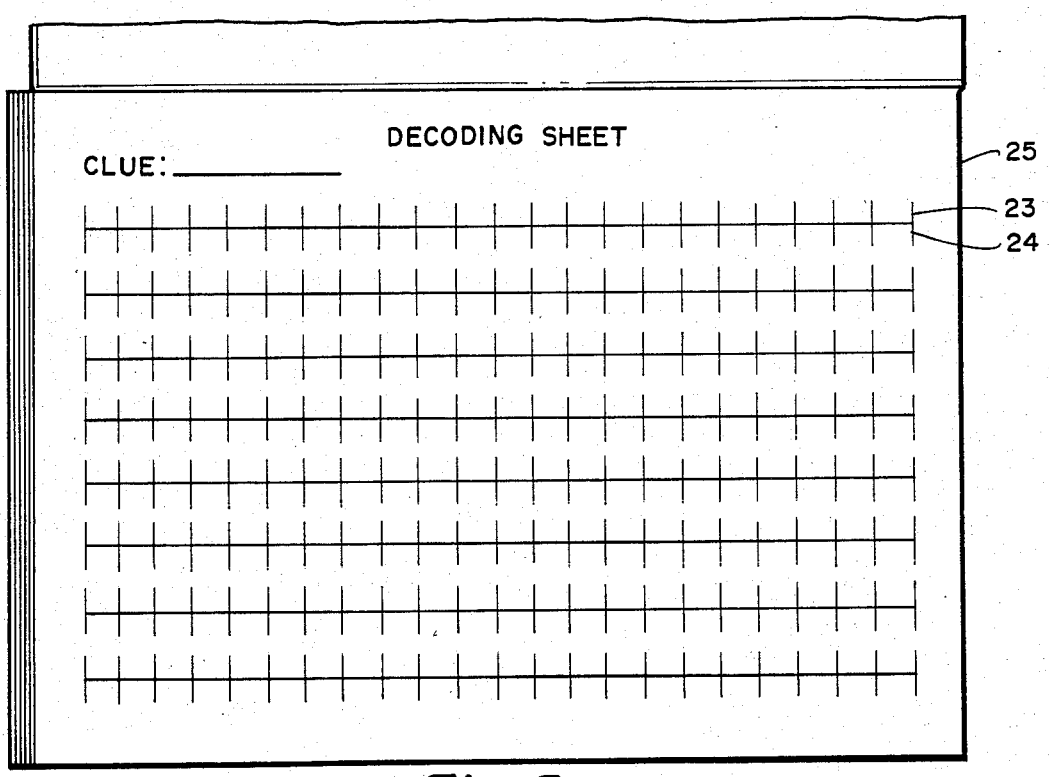
FIG. 5 illustrates a pad containing decoding sheets provided to the players, whereupon the encrypted message is written, and the player attempts to decode the message.

Referring now to the drawings, FIGS. 1, 2 and 3 illustrate the encrypting device forming part of the game of the present invention. The encrypting device comprises a rectangular container 11 containing a plurality of compartments 12, arranged in two linear parallel rows. Each compartment is uniquely labeled with a letter of the alphabet, as indicated at 13. Box 11 is generally opaque, being provided with a transparent window section 14 overlying the two rows of compartments 12 and their accompanying letter indicia 13. A plurality of die-like cubes 15, one for each letter of the alphabet, is provided. The cubes are adapted to loosely fit into compartments such as 12. As illustrated in FIGS. 1 and 3, the lettered compartments 12 are arranted in thirteen pairs, adjacent one another. It will be apparent, therefore, that twenty-six compartments, one for each letter of the alphabet, are provided. A pair of shelves, 16 and 17, are provided, each adjacent one row of letter-labeled compartments. Shelves 16 and 17 provide space for cubes 15 to randomly move about while container 11 is shaken in the rotary manner illustrated in FIG. 3. Smaller rotations are employed to urge each of cubes 15 into an individual compartment 12. Each of the cubes 15 bears an individual letter of the alphabet, preferably imprinted on each of the six sides of the cube.

In order to provide the substitution cypher for encryptment, a player turns the container 11 over, so that any cubes 15 in compartments 12 will fall out and be available for play. The container 11 is then turned upright, and shaken in the rotary manner illustrated in FIG. 3. The container 11 is shaken until each of the cubes 15 has lodged individually in one of the compartments 12. With each individually lettered cube 15 in an individually labeled compartment 12, a simple substitution cypher is formed.

A pad 21, containing a plurality of pages bearing messages to be encrypted, such as message 22, is provided. The player holding the encrypting device selects a message to be encrypted from those provided in pad 21. The message, exemplarly message 22, is encrypted, and the message so coded is audibly recided to the other players. Each of the players writes down the letters forming the encrypted message in the square provided on the upper line 23 of a pair of lines of squares provided on decoding sheet 25. Dashes between words and punctuation are provided by the encrypter and are written on the decoding sheet 25 by each of the other players. In addition, a category clue, such as statement 26, from the coded message form 22 is provided to the players.

A first player then attempts to guess audibly one of the original letters substituted by the code. The cryptographer then responds with a "yes" or "no" answer. The next player to the left of the cryptographer then attempts to determine the pairs of letters making up the code. Again, the cryptographer replies with "yes" or "no" answers. The other players in turn attempt to determine the pairs of letters forming the code. To assist the players "category" and "trivia" clues are provided audibly and inserted on the lower line 24. These clues, together with any letter pairs guessed, enable a player to eventually determine the encrypted message. The excitement of the game is enhanced if a time limit is set. A time limit of ten minutes has been found to provide interest and excitement for each game. Any of the players, believing he has solved the coded message, shows the decoded message to the cryptographer for verification at his turn of play. If the guess is incorrect, the guessing player is disqualified and play continues. Play ends for that particular game when a player guesses the message or when the alloted time has expired.

The various features and advantages of the invention are thought to be clear from the foregoing description. However, various other features and advantages not specifically enumerated will occur to those skilled in the art, as will variations and modifications of the preferred embodiment illustrated, all of which may be achieved without departing from the spirit and scope of the invention as defined by the following claims.

I claim:

1. Cryptographic game apparatus comprising:

a. an encrypting device for producing chance pairs of alphabetical indicia forming a sample substitution cypher;

b. a first sheet containing a message to be encrypted employing said pairs of alphabetical indicia; and, c. a plurality of additional sheets, one for each player, whereupon said players write the encrypted message and attempt to determine the alphabetical pairs to recover the original message, said encrypting device including:

1. a container;
2. a plurality of substantially identical compartments having open tops;
3. alphabetical indicia uniquely identifying each of said compartments;
4. a plurality of markers adapted to fit in said compartments; and,
5. alphabetical indicia uniquely identifying each of said markers.

2. In the cryptographic game apparatus set forth in claim 1 said compartments being substantially rectangular and arranged in two adjacent rows:

a. a shoulder adjacent each of said rows of compartments; and,
b. alphabetical indicia on said shoulders, an individual letter adjacent such compartment identifying said compartment.

3. In the cryptographic game apparatus set forth in claim 2, each of said markers comprising:

a. a cube adapted to loosely fit into said compartments; and,
b. individual alphabetical indicia imprinted on each of said cubes for identifying each of said cubes.

4. In the cryptographic game apparatus set forth in claim 3, said first sheet comprising:

a. first set of horizontal rows of blocks, each containing one letter of the message to be encrypted;
b. a second set of rows of blocks, each below and adjoining the blocks of said first row, enabling the letters of an encrypted message to be entered directly below the corresponding letter of the message.

5. In the cryptographic game apparatus set forth in claim 4, each of said additional sheets comprising:

a. a first set of horizontal rows of blocks; and
b. a second set of horizontal rows of blocks, each directly below a corresponding one of said first blocks, whereby a player enters the letter indicia comprising the encrypted message in said first set of blocks and decrypted letters of said message in said second set of blocks.

6. The method of playing a cryptographic game comprising the steps of:

a. a first player selecting a message to be encrypted;
b. said first player manipulating a container having alphabetically labeled compartments and alphabetically labeled markers, whereby each of said markers is randomly placed in one of said alphabetically labeled compartments, thereby forming a simple substitution cypher;
c. said first player notifying other players of the substituted letters forming the encrypted message, together with at least one prearranged clue;
d. said other players in turn attempting to determine the pairs of letters randomly combined by said markers in said compartments; and,
e. providing a time limit for each of said other players to decrypt said encrypted message.

* * * * *